US007703573B2

(12) United States Patent
Feight et al.

(10) Patent No.: US 7,703,573 B2
(45) Date of Patent: Apr. 27, 2010

(54) PORTED AERODYNAMIC EXHAUST TAILPIPE

(75) Inventors: Robert Preston Feight, Duvall, WA (US); Wayne K. Simons, Kent, WA (US); Daniel R. Kieffer, Kirkland, WA (US)

(73) Assignee: PACCAR Inc, Bellevue, WA (US)

( * ) Notice: Subject to any disclaimer, the term of this patent is extended or adjusted under 35 U.S.C. 154(b) by 172 days.

(21) Appl. No.: 11/198,652

(22) Filed: Aug. 5, 2005

(65) Prior Publication Data

US 2007/0029132 A1 Feb. 8, 2007

(51) Int. Cl.
*F01N 1/14* (2006.01)
*F01N 3/05* (2006.01)
*B60K 13/04* (2006.01)

(52) U.S. Cl. ..... 181/239; 181/227; 181/228; 181/248; 181/262; 180/309; 180/68.3; 60/317

(58) Field of Classification Search ..... 181/239, 181/238, 227, 228, 236, 247, 248, 262, 263; 180/309, 89.2, 296, 68.3; 60/317, 319; D12/194
See application file for complete search history.

(56) References Cited

U.S. PATENT DOCUMENTS 940,031 A * 11/1909 Krotz ..... 180/309
1,110,040 A * 9/1914 Chatain ..... 60/322
1,342,464 A * 6/1920 Sawders et al. ..... 181/239
1,483,805 A * 2/1924 Heath ..... 181/239
1,521,074 A * 12/1924 Carr ..... 181/227
1,766,973 A * 6/1930 Beck ..... 181/236
1,922,825 A * 8/1933 Squires ..... 244/53 R
1,989,675 A * 2/1935 Bobo ..... 181/239
2,112,534 A * 3/1938 Keen ..... 239/418
2,270,115 A * 1/1942 Eliot ..... 181/263
2,323,891 A * 7/1943 Blanchard ..... 181/238
2,326,446 A 8/1943 Eby
2,370,062 A * 2/1945 Mercier ..... 60/320
2,386,305 A * 10/1945 Flickinger ..... 181/259
2,610,570 A 9/1952 Valensi
2,659,293 A 11/1953 Valensi
D174,138 S 3/1955 Russo
2,725,948 A * 12/1955 Keene ..... 181/262
2,845,775 A * 8/1958 Meyer et al. ..... 181/215
2,896,739 A * 7/1959 Kuras ..... 181/239
3,422,742 A 1/1969 Valensi (Continued)

FOREIGN PATENT DOCUMENTS

JP 52044325 A * 4/1977

*Primary Examiner*—Edgardo San Martin
(74) *Attorney, Agent, or Firm*—Christensen O'Connor Johnson Kindness PLLC

(57) ABSTRACT

A tailpipe for use with a vehicle moveable in a forward direction upon a support surface and adapted to be oriented substantially perpendicular to the support surface. The tailpipe includes a windward surface facing in the forward direction and a leeward surface facing opposite the forward direction. The tailpipe also includes a tubular body defining a main exhaust gas flow passageway adapted to direct an exhaust gas flow from a proximal end to a distal end of the tubular body and a plurality of exhaust ports. The exhaust ports are disposed between the proximal end and the distal end of the tubular body and pass through the leeward surface for permitting at least a portion of the exhaust gas flow, when present in the tubular body, to exit the tubular body through the plurality of exhaust ports.

12 Claims, 6 Drawing Sheets

U.S. PATENT DOCUMENTS 3,628,885 A * 12/1971 Sidenstick et al. ..... 416/217
3,669,216 A * 6/1972 Spies ..... 181/240
3,683,624 A * 8/1972 Williams ..... 60/275
3,695,388 A * 10/1972 Paxhia et al. ..... 181/206
3,865,311 A * 2/1975 Paxhia et al. ..... 239/568
3,952,823 A * 4/1976 Hinderks ..... 180/309
4,665,691 A * 5/1987 Eller ..... 60/316
4,792,014 A * 12/1988 Shin-Seng ..... 181/280
4,842,096 A * 6/1989 Fujitsubo ..... 181/252
D357,665 S * 4/1995 Creyts ..... D12/194
5,699,965 A * 12/1997 Amelio ..... 239/127.3
5,881,554 A * 3/1999 Novak et al. ..... 60/302
5,909,782 A 6/1999 Pluff et al.
6,220,387 B1 * 4/2001 Hoppes et al. ..... 181/259
D536,649 S * 2/2007 Monson et al. ..... D12/194
2007/0163247 A1 * 7/2007 Ryan et al. ..... 60/288

* cited by examiner

PORTED AERODYNAMIC EXHAUST TAILPIPE

FIELD OF THE INVENTION

The illustrated embodiments of the present invention relate generally to tailpipes of vehicle exhaust systems, and more particularly to tailpipes having exhaust gas discharge ports for improving the aerodynamic properties of the tailpipe.

BACKGROUND OF THE INVENTION

Motor vehicles, and in particular trucks, are a critical component of the system for transporting materials, goods, and people from place to place. The amount of energy required to move such vehicles depends on many factors. For instance, a substantial amount of energy is expended to overcome the resistance (drag) encountered in moving the vehicle through air. The amount of energy expended depends in large part on the aerodynamic drag force exerted on the vehicle by the air. By decreasing the aerodynamic drag force exerted on the vehicle, the operating cost of the vehicle can be significantly reduced. Thus, there exists a need for ways of reducing the aerodynamic drag force exerted upon the vehicle as the vehicle moves through an airstream. It has been discovered that the portions of an exhaust system which are disposed in the airstream result in a significant increase in the drag force exerted upon the vehicle. Thus, there exists a need for an exhaust system that is more aerodynamic over previously developed exhaust systems.

SUMMARY OF THE INVENTION

One embodiment of a tailpipe formed in accordance with the present invention and suitable for use with a vehicle moveable in a forward direction upon a support surface is disclosed. The tailpipe includes a tubular body adapted to be oriented substantially perpendicular to the support surface. The tubular body defines a main exhaust gas flow passageway for directing an exhaust gas flow from a proximal end to a distal end of the tubular body. The tailpipe includes a windward surface facing in the forward direction and a leeward surface facing opposite the forward direction. The tailpipe also includes a tubular body defining a main exhaust gas flow passageway adapted to direct an exhaust gas flow from a proximal end to a distal end of the tubular body and a plurality of exhaust ports. The plurality of exhaust ports are disposed between the proximal end and the distal end of the tubular body and pass through the leeward surface for permitting at least a portion of the exhaust gas flow, when present in the tubular body, to exit the tubular body through the plurality of exhaust ports.

Another embodiment of a tailpipe formed in accordance with the present invention and suitable for use with a vehicle is disclosed. The tailpipe is adapted to be coupled to an exhaust system. The tailpipe includes a tubular body defining a main exhaust gas flow passageway adapted to direct an exhaust gas flow from a proximal end to a distal end of the tubular body and a main discharge port disposed at the distal end of the tubular body. The tailpipe also includes a plurality of secondary exhaust ports disposed between the proximal end and the distal end of the tubular body for permitting a portion of the exhaust gas flow, when present in the tubular body, to exit the tubular body prior to discharge via the main discharge port.

Still another embodiment of a tailpipe formed in accordance with the present invention and suitable for use with a vehicle moveable in a direction of travel is disclosed. The tailpipe is adapted to be coupled to an exhaust gas processing device for receiving exhaust gases from the exhaust gas processing device. The tailpipe includes a windward surface adapted to face in the direction of travel and a leeward surface adapted to face away from the direction of travel. The tailpipe also includes a plurality of exhaust ports located upon the leeward surface for discharging a first portion of the exhaust gases from the tailpipe and an exhaust gas discharge opening located at a distal end of the tailpipe for discharging a second portion of the exhaust gases from the tailpipe.

BRIEF DESCRIPTION OF THE DRAWINGS

The foregoing aspects and many of the attendant advantages of this invention will become better understood by reference to the following detailed description, when taken in conjunction with the accompanying drawings, wherein.

DETAILED DESCRIPTION OF THE PREFERRED EMBODIMENT

Figure 1:
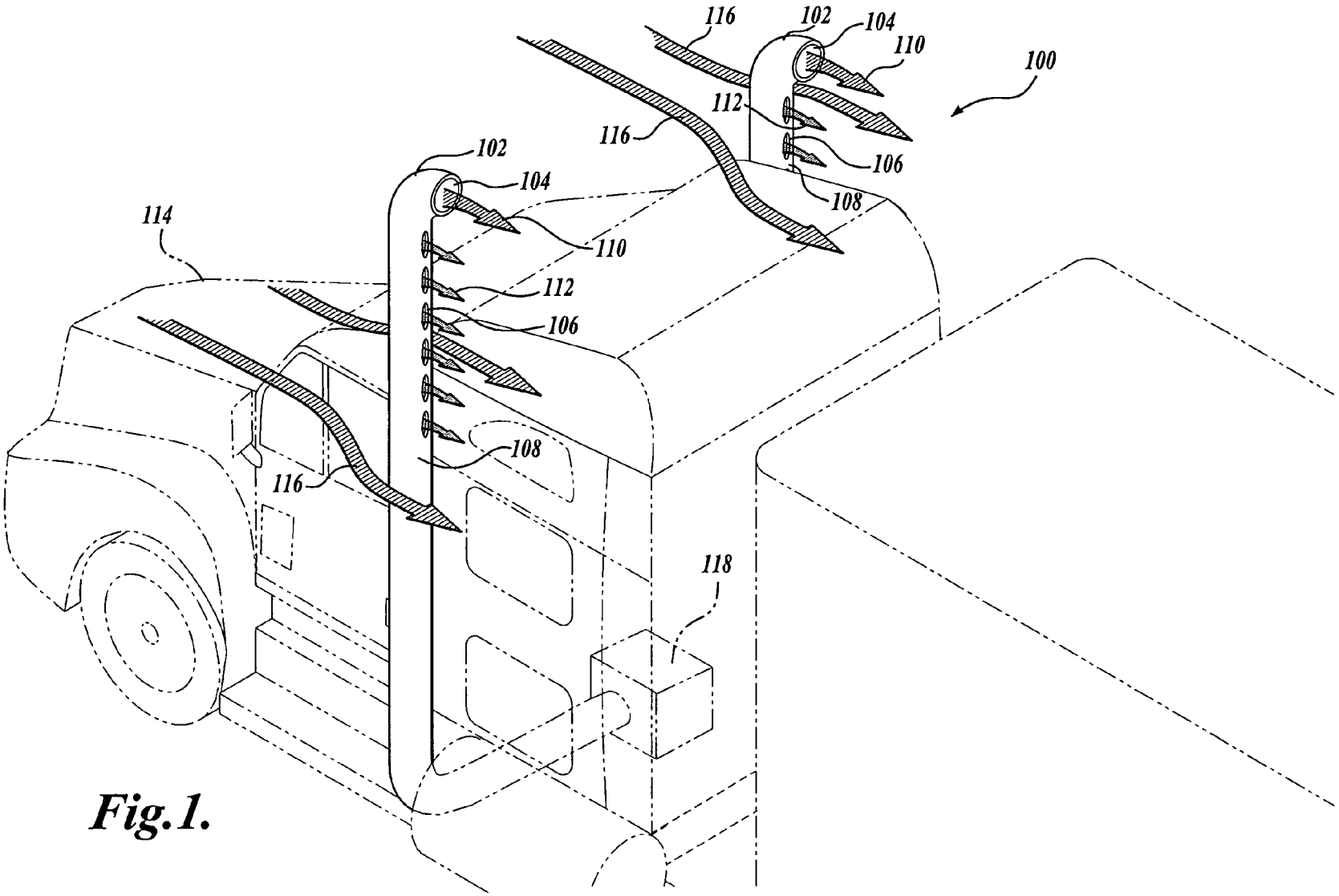
FIG. 1 is a rear perspective view of one embodiment of a tailpipe formed in accordance with the present invention, the tailpipe shown coupled to a truck.

One embodiment of an exhaust system 100 formed in accordance with the present invention is shown in FIGS. 1-8. Referring to FIG. 1 and generally described, the exhaust system 100 includes a tailpipe 102 which may be vertically oriented. The tailpipe 102 may include a main discharge port 104 and a plurality of secondary exhaust ports 106 disposed on a leeward side 108 of the tailpipe 102. A first portion 112 of an exhaust stream passing through the tailpipe 102 may be discharged out the secondary exhaust ports 106A and a second portion 110 of the exhaust stream may be directed out the main discharge port 104. The introduction of the pressurized exhaust stream along the leeward side 108 of the tailpipe 102 via the secondary exhaust ports 106 "fills in" a low static pressure area that is resident along the leeward side 108 of the tailpipe 102 during forward movement of the vehicle 114. The increase in pressure caused by the introduction of a portion of the exhaust stream in this low pressure area reduces the drag associated with the tailpipe 102 as the tailpipe 102 passes through the airstream 116 caused by the forward movement of the vehicle 114, thereby improving the vehicle's aerodynamics.

Figure 2:
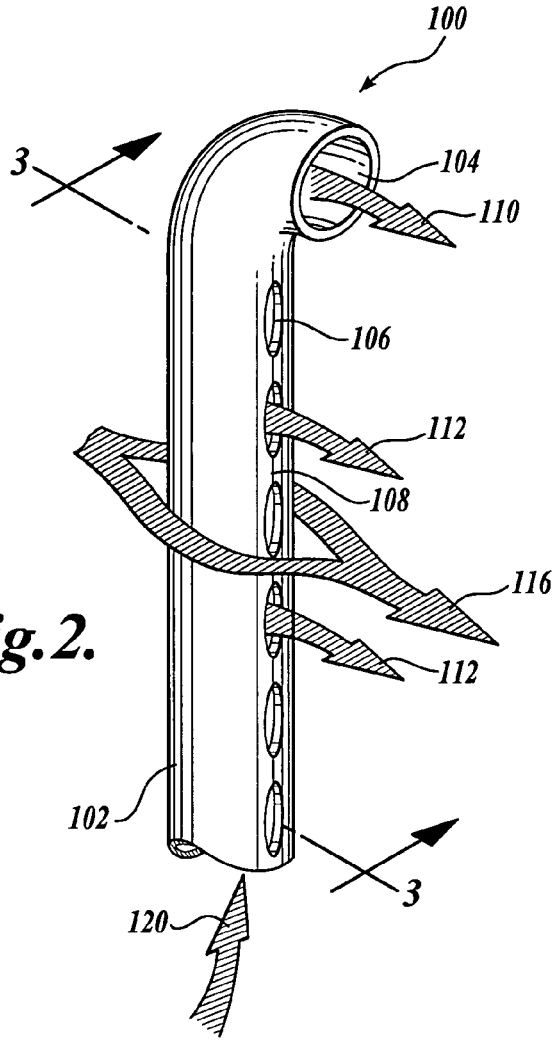
FIG. 2 is a rear perspective view of the tailpipe of FIG. 1.
Figure 3:
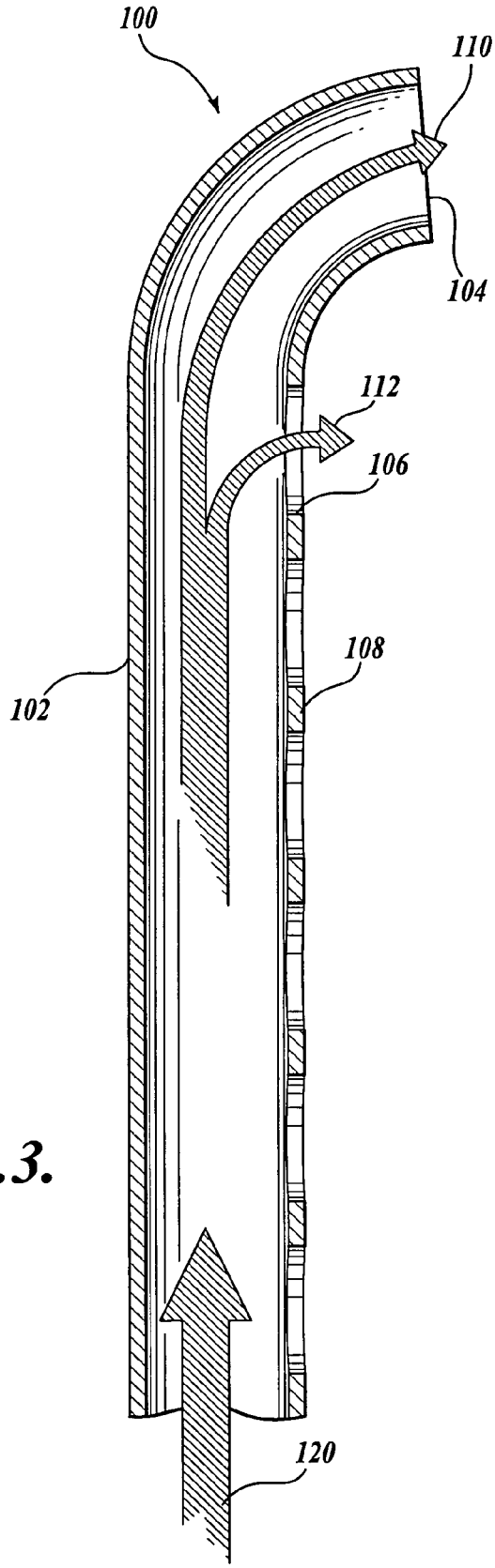
FIG. 3 is a cross-sectional view of the tailpipe of FIG. 2, the cross-sectional cut taken through Section 3-3 of FIG. 2.

Turning to FIGS. 2 and 3 and based on the above general description of the exhaust system 100, the components of the exhaust system will now be described in greater detail. As stated above, the exhaust system 100 includes a tailpipe 102. The tailpipe 102 may have a tubular body adapted to couple to an exhaust system of the vehicle. Typically, the tailpipe 102 is coupled to an exhaust gas processing device of the vehicle's exhaust system, a few suitable examples being a diesel particulate filter, sound deadening device, catalytic converter, or a muffler 118 as shown in FIG. 1 to receive exhaust gas 120 processed and subsequently discharged by the exhaust gas processing device.

Figure 16:
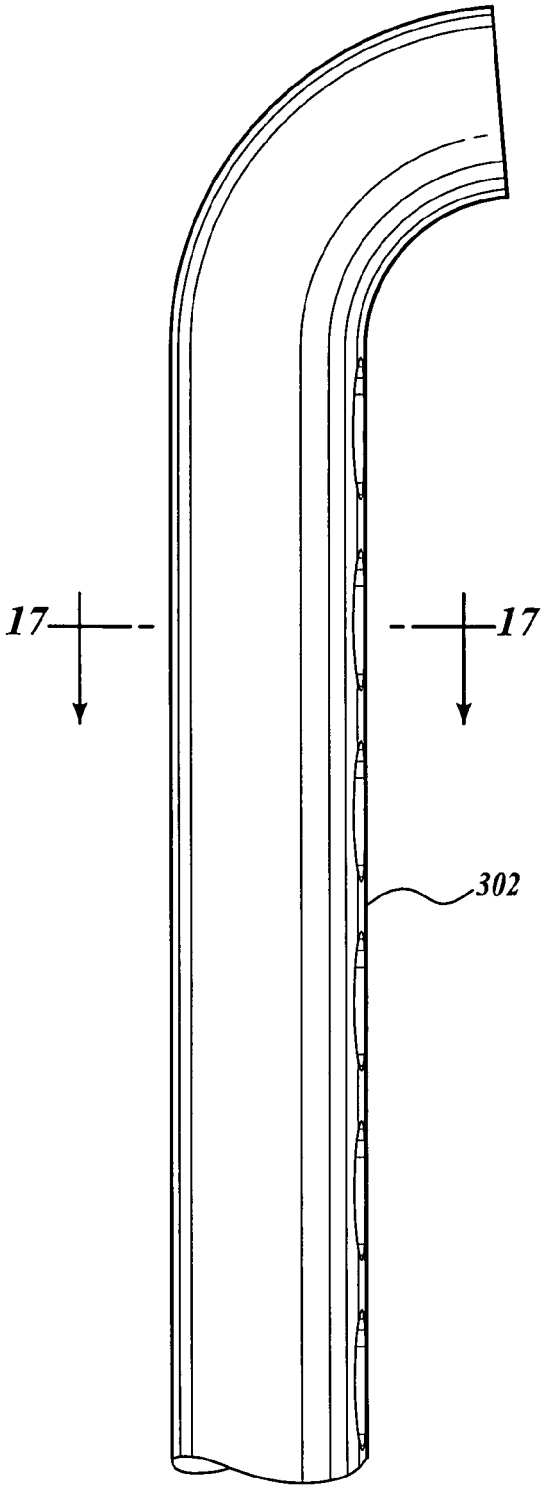
FIG. 16 is a side elevation view of an alternate embodiment of a tailpipe formed in accordance with the present invention, the tailpipe having an aerodynamic cross-sectional shape.
Figure 17:
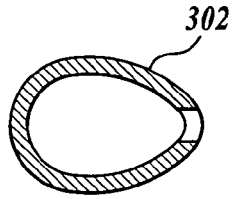
FIG. 17 is a cross-sectional view of the tailpipe of FIG. 16, the cross-sectional cut taken through Section 17-17 of FIG. 16.

The tailpipe 102 may be round in cross-section, or may be shaped to have any other cross-sectional shape, such as other geometric shapes or combination of geometric shapes. The tailpipe 102 may be constant in cross-sectional shape along its length, or may vary in cross-sectional shape along its length. The tailpipe 102 may also be aerodynamically shaped to reduce aerodynamic drag. For instance, referring to FIGS. 16 and 17, the tailpipe 302 may have a non-round aerodynamically shaped cross-section, one suitable example being the tear-dropped cross-sectional profile shown in FIGS. 16 and 17.

Returning to FIGS. 2 and 3, the tailpipe 102 may be made of any rigid or semi rigid material, a few suitable examples being composite materials and/or metals, such as a steel with a chrome finish, or stainless steel. The tailpipe 102 may be vertically oriented as shown so as to be oriented perpendicular to a support surface, such as a road, or oriented in any other suitable orientation, one example being substantially horizontal so as to be oriented parallel to the support surface. The tailpipe 102 may be of any suitable cross-sectional area suitable to permit a sufficient amount of exhaust gas 120 to flow therethrough without resulting in excessive exhaust back pressures being formed at the engine. In one working embodiment, a pair of tailpipes 102 are used having round cross-sections of about 5 to 7 inches in diameter, with the actual diameter chosen depending on the size of the engine in which the tailpipes will be interfaced with.

The tailpipe 102 may terminate in a main discharge port 104 located at a distal end of the tailpipe 102. The main discharge port 104 may be used to discharge any exhaust gases still present in the tailpipe 102 out the distal end of the tailpipe 102. The main discharge port 104 may be oriented in any direction. In the illustrated embodiment, the main discharge port 104 is substantially vertically oriented and oriented to face substantially in the opposite direction of forward travel of the vehicle (i.e. facing aft) such that exhaust gases discharged from the main discharge port 104 are discharged substantially opposite the direction of travel and behind the tailpipe 102. In another embodiment, the main discharge port 104 is oriented horizontally so as to direct exhaust gases discharged therefrom vertically upward. In the illustrated embodiment, the discharge port 104 is approximately circular in shape and between about 5 to 7 inches in diameter. Although a specific shape and size of the main discharge port is herein illustrated and described, it should be noted that the main discharge port 104 may take many other shapes, sizes, and orientations, without departing from the spirit and scope of the present invention.

The tailpipe 102 may include one or more secondary exhaust ports 106. The secondary exhaust ports 106 may be disposed anywhere along the length of the tailpipe 104 between a proximal end attached to the muffler 118 (see FIG. 1) to the distal end having the main discharge port 104. Preferably, the secondary exhaust ports 106 are positioned between a proximal and distal end of the tailpipe. For instance, the secondary exhaust ports 106 may be disposed along the portion of the tailpipe 102 which is disposed in the airstream 116 passing around the vehicle during forward movement of the vehicle. The secondary exhaust ports 106 may be positioned such that exhaust gases discharged from the secondary exhaust ports 106 is directed to (fills) the low pressure region disposed adjacent the leeward side 108 of the tailpipe 102 as the tailpipe is moved through the airstream 116. In the illustrated embodiment, the secondary exhaust ports 106 are disposed along and pass through the leeward side of the tailpipe 102.

Figures 4, 5, 6, 7, 8:
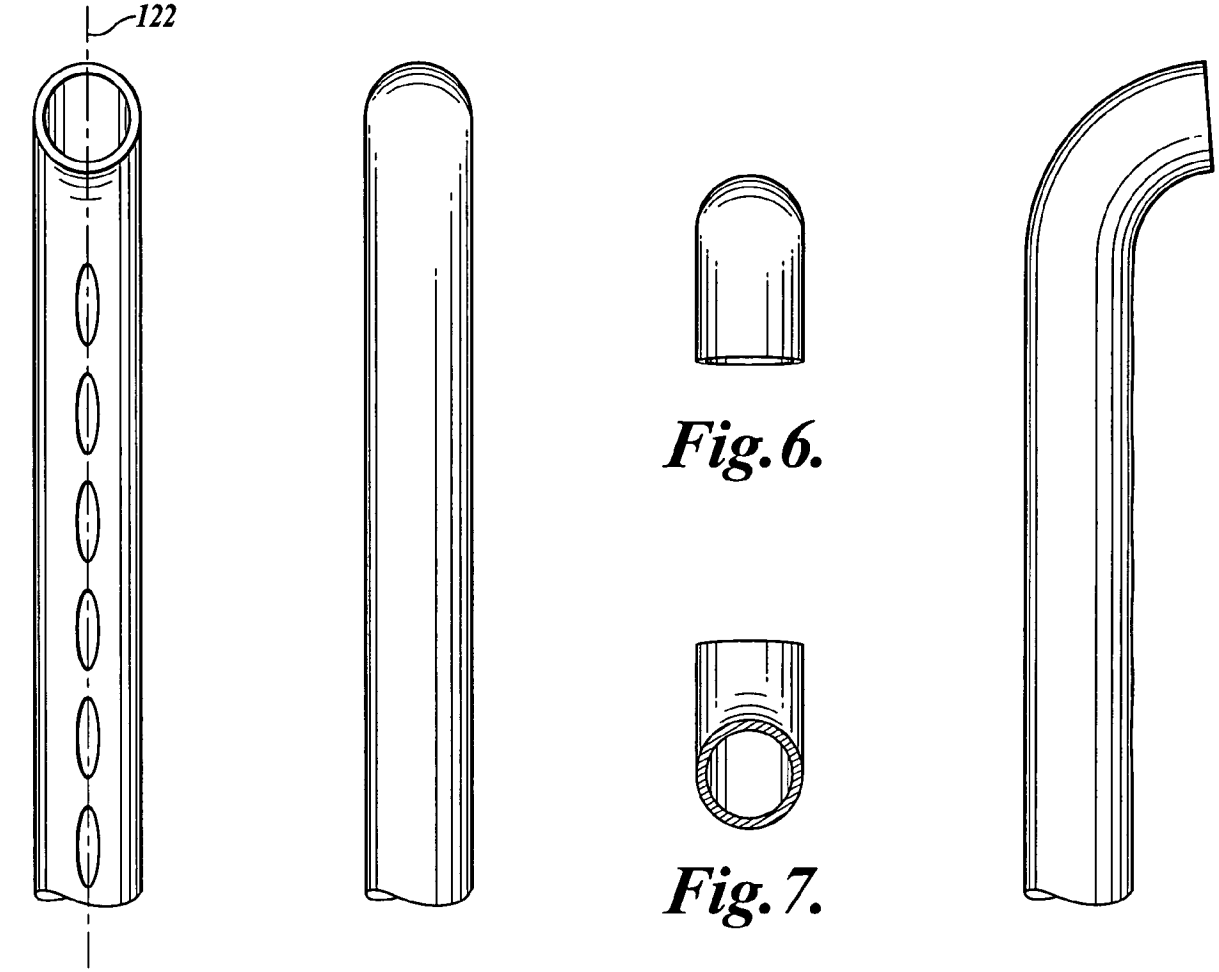
FIG. 4 is a rear elevation view of the tailpipe of FIG. 2.
FIG. 5 is a front elevation view of the tailpipe of FIG. 2.
FIG. 6 is a top planar view of the tailpipe of FIG. 2.
FIG. 7 is a bottom planar view of the tailpipe of FIG. 2.
FIG. 8 is a side elevation view of the tailpipe of FIG. 2.
Figure 9:
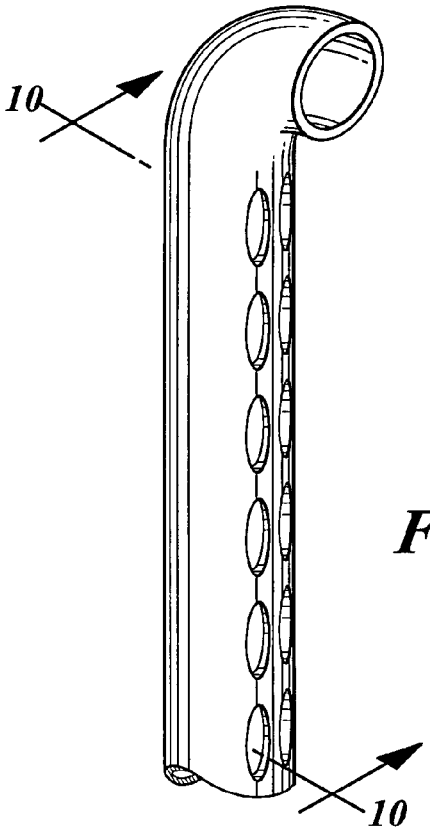
FIG. 9 is a rear perspective view of an alternate embodiment of a tailpipe formed in accordance with the present invention.
Figure 10:
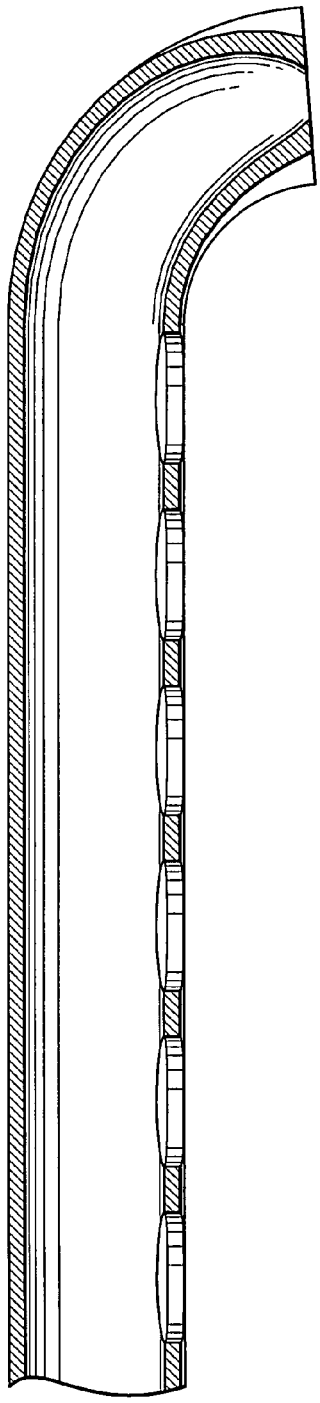
FIG. 10 is a cross-sectional view of the tailpipe of FIG. 9, the cross-sectional cut taken through Section 10-10 of FIG. 9.
Figures 11, 12, 13, 14, 15:
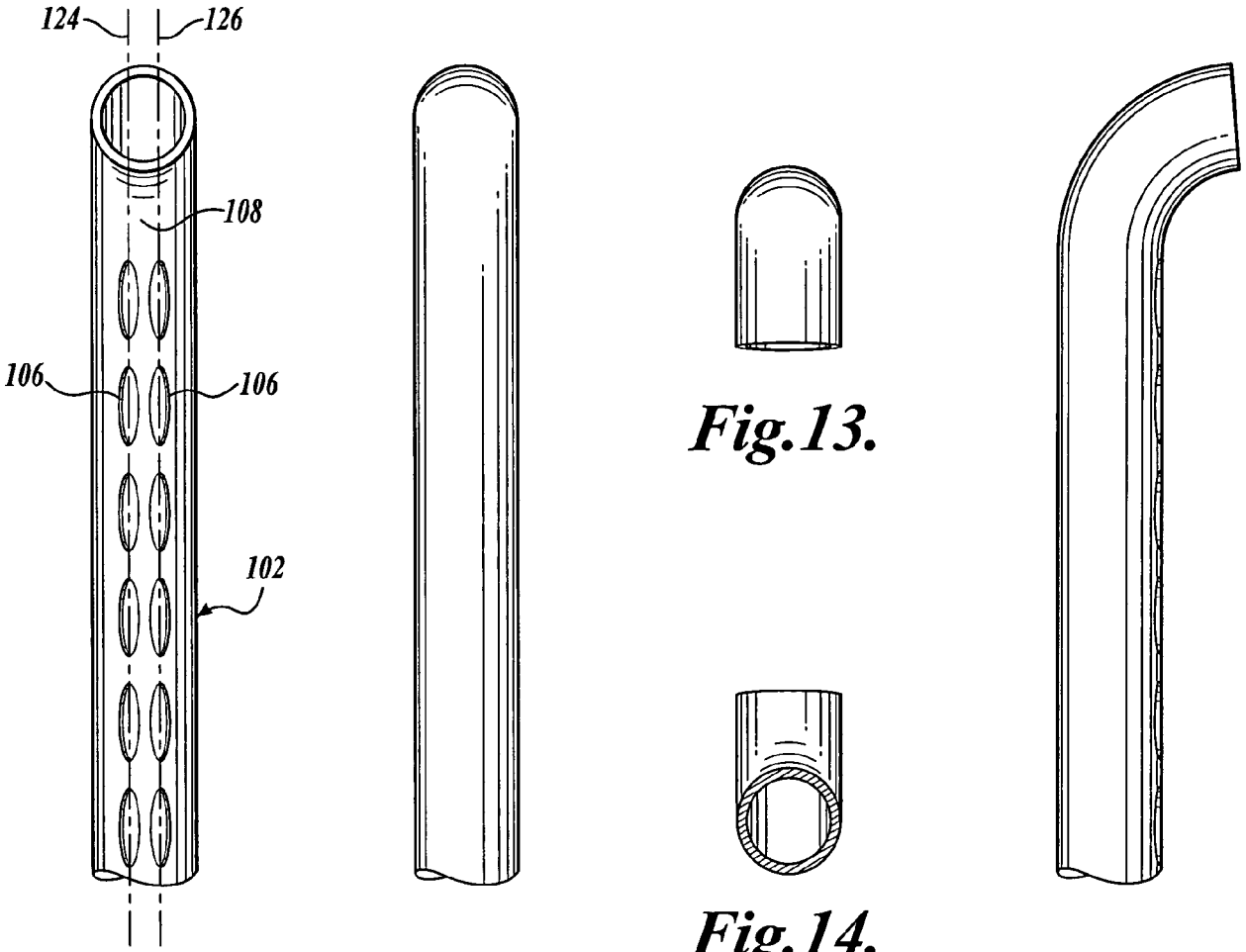
FIG. 11 is a rear elevation view of the tailpipe of FIG. 9.
FIG. 12 is a front elevation view of the tailpipe of FIG. 9.
FIG. 13 is a top planar view of the tailpipe of FIG. 9.
FIG. 14 is a bottom planar view of the tailpipe of FIG. 9.
FIG. 15 is a side elevation view of the tailpipe of FIG. 9.

The secondary exhaust ports 106 may be arranged in any suitable manner relative to one another and may be of any suitable size and shape. For instance, the secondary exhaust ports 106 may be orderly arranged in an array upon the leeward surface, seemingly randomly placed, or a combination thereof. In the illustrated embodiment of FIG. 2, the secondary exhaust ports 106 are positioned along a vertically oriented imaginary line 122 (see FIG. 4) passing along the leeward side and bisecting the leeward side into two equal sections as best shown in FIG. 4. As another example, referring to FIGS. 9-15, the secondary exhaust ports 106 are positioned along two vertically oriented imaginary lines 124 and 126 passing along the leeward side 108 and spaced a predetermined distance from each side of the centerline 122 (see FIG. 4), such that the secondary exhaust ports 106 are positioned in two columns along the length of the tailpipe 102 and on the leeward side 108 of the tailpipe 102.

Still referring to FIGS. 2 and 3, in the illustrated embodiment, the secondary exhaust ports 106 are shaped as ovals with the length of the oval aligned with the longitudinal length of the tailpipe. However, it should be noted to those skilled in the art, that the secondary exhaust ports 106 may be formed to have any suitable shape, such as geometric shapes other than oval, or any combination of geometric shapes. A few suitable examples of other shapes for the secondary exhaust ports 106 include rectangles, circles, squares, triangles, linear slits, arcuate slits, diamonds, and combinations thereof. Further, although the size and shape of each of the secondary exhaust ports 106 is illustrated and described as being uniform, it is noted that the size and/or shape of the secondary exhaust ports may vary between one another. For instance, in one alternate embodiment, the secondary exhaust ports 106 increase in size as they approach the distal end of the tailpipe 102 and change in shape. In another embodiment, the secondary exhaust ports 106 comprise a single or multiple vertical slits that extend vertically along the leeward side of the portion of the tailpipe which is disposed in the airstream. The slit(s) may expand in width (taper) as the slit approaches the distal end of the tailpipe 102.

The combined area of the secondary exhaust ports 106 may be selectively chosen to obtain a predetermined ratio of a first portion 112 of the exhaust gases 120 entering the tailpipe 102 exiting the secondary exhaust ports 106 relative to a second portion 110 of the exhaust gases 120 exiting the main discharge port 104. For instance, in one embodiment, at a design cruising RPM of an engine coupled to the tailpipe, the relative total area of the main discharge port 104 relative to the total area of the secondary exhaust ports 106 is selected such that between 40% and 100% of the exhaust gases 120 exit the secondary exhaust ports 106. Other percentages are also suitable, such as greater than about 50%, 60%, 70%, 80%, or 90%. In the case where 100% of the exhaust gases 120 are directed out the secondary exhaust ports 106, the main discharge port 104 may be eliminated or present for aesthetic purposes, but blocked such that no exhaust gases flow through the main discharge port 104.

To permit between 40% and 100% of the exhaust gases 120 to exit the secondary exhaust ports 106, the total surface area of the secondary exhaust ports 106 may be 40% or greater than the area of the main discharge port 104. In one embodiment, the total area of the secondary exhaust ports 106 is greater than or equal to the area of the main discharge port 104. In another embodiment, the total area of the secondary exhaust ports 106 is greater than or equal to 1.5 times the area of the main discharge port 104. In still another embodiment, the total area of the secondary exhaust ports 106 is greater than or equal to about 2 times the area of the main discharge port 104.

Although the above described exhaust systems are depicted and described with two tailpipes, it should be apparent to those skilled in the art that this is done for illustrative purposes only, and embodiments having one or three or more tailpipes are also within the spirit and scope of the present invention.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A method for reducing drag to improve the aerodynamics of a moving vehicle, the method comprising:

moving a vehicle on a roadway or surface to create an airstream, wherein the vehicle has an exhaust system coupled to a tailpipe;

providing the tailpipe with an elongated hollow body and a main discharge port at the distal end of the body;

providing one or more secondary exhaust gas ports restricted to a leeward side surface of the tailpipe and prior to the main discharge port, the one or more secondary ports being sized to exhaust sufficient gas to increase the pressure behind the tailpipe;

providing the tailpipe on the vehicle wherein the forward side of the tailpipe opposite to the secondary ports is impacted by the airstream and the side of the tailpipe with the secondary exhaust ports is shielded from the airstream by the forward side of the tailpipe;

discharging exhaust gases from the exhaust system through the one or more secondary exhaust ports before the main discharge port;

with the discharged exhaust gases, filling in a low static pressure area that is resident along the leeward side of the tailpipe during forward movement of the vehicle; and reducing the drag associated with the tailpipe as the tailpipe passes through the airstream caused by the forward movement of the vehicle.

2. The method of claim 1, wherein the tailpipe is vertically disposed on the vehicle.

3. The method of claim 1, wherein the area of the one or more secondary exhaust ports is 40% or greater than the area of the main discharge port.

4. The method of claim 1, wherein the plurality of secondary exhaust ports are non-circular in shape.

5. The method of claim 1, wherein the plurality of secondary exhaust ports are substantially oval in shape.

6. The method of claim 1, wherein a total area of the plurality of secondary exhaust ports is substantially equal to or greater than an area of the main discharge port.

7. The method of claim 1, wherein a total area of the plurality of secondary exhaust ports is substantially equal to or greater than 1.5 times an area of the main discharge port.

8. The method of claim 1, wherein the plurality of secondary exhaust ports are located only along 50% or less of a length of the tailpipe.

9. The method of claim 1, wherein the tailpipe is substantially round in cross-section.

10. The method of claim 1, wherein the tailpipe has a non-round cross-sectional shape.

11. The method of claim 1, wherein the plurality of secondary exhaust ports and the main discharge port all face substantially in a first direction.

12. The method of claim 1, wherein the exhaust system comprises a muffler coupled to the tailpipe.

* * * * *